US009182164B1

(12) United States Patent
Henderson, Jr.

(10) Patent No.: US 9,182,164 B1
(45) Date of Patent: Nov. 10, 2015

(54) PORTABLE AIR CONDITIONING SYSTEM

(71) Applicant: Charles E. Henderson, Jr., Pittsburgh, PA (US)

(72) Inventor: Charles E. Henderson, Jr., Pittsburgh, PA (US)

( * ) Notice: Subject to any disclaimer, the term of this patent is extended or adjusted under 35 U.S.C. 154(b) by 454 days.

(21) Appl. No.: 13/670,054

(22) Filed: Nov. 6, 2012

Related U.S. Application Data

(63) Continuation-in-part of application No. 12/541,031, filed on Aug. 13, 2009, now abandoned.

(51) Int. Cl.
*F25D 15/00* (2006.01)
*F25D 11/00* (2006.01)
*F25B 1/00* (2006.01)

(52) U.S. Cl.
CPC ..... *F25D 11/003* (2013.01); *F25B 1/005* (2013.01)

(58) Field of Classification Search
CPC ..... F24F 1/022; F24F 1/025; F24F 1/04; F24F 1/02; F25D 11/003; F25D 1/005
USPC ..... 62/425, 237
See application file for complete search history.

(56) References Cited

U.S. PATENT DOCUMENTS

| | | | | | |
|---|---|---|---|---|---|
| 630,617 | A | | 8/1899 | Marshall | |
| 1,933,771 | A | * | 11/1933 | Strang et al. | 62/305 |
| 2,125,542 | A | * | 8/1938 | Catterlin | 62/259.1 |
| 2,486,226 | A | * | 10/1949 | Trask | 62/428 |
| 2,661,606 | A | | 12/1953 | Trask | |
| 2,891,389 | A | * | 6/1959 | Tull | 62/298 |
| 3,151,791 | A | | 10/1964 | Pietsch | |
| 3,159,983 | A | | 12/1964 | Metcalfe | |
| 3,205,676 | A | * | 9/1965 | Walker et al. | 62/226 |
| 3,524,328 | A | | 8/1970 | Schuster | |
| 3,659,433 | A | * | 5/1972 | Shaw | 62/511 |
| 3,740,964 | A | | 6/1973 | Herweg | |
| 4,027,498 | A | * | 6/1977 | Fessler | 62/263 |
| 4,135,370 | A | * | 1/1979 | Hosoda et al. | 62/274 |
| 4,255,940 | A | | 3/1981 | Grahl et al. | |
| 4,641,503 | A | * | 2/1987 | Kobayashi | 62/259.1 |
| 4,841,739 | A | * | 6/1989 | Wallner | 62/174 |
| 4,841,742 | A | | 6/1989 | Biby | |
| D306,062 | S | | 2/1990 | Moritani | |
| 4,967,569 | A | | 11/1990 | Machen et al. | |
| 5,249,438 | A | * | 10/1993 | Rhaney et al. | 62/457.7 |
| 5,255,527 | A | | 10/1993 | Paige | |
| 5,445,397 | A | * | 8/1995 | Evans | 280/47.18 |
| 5,737,938 | A | | 4/1998 | Liu | |
| 5,762,129 | A | * | 6/1998 | Elliott | 165/48.1 |
| 5,839,654 | A | | 11/1998 | Weber | |
| 5,997,825 | A | | 12/1999 | Satyapal et al. | |
| 6,539,735 | B1 | | 4/2003 | Schmidt | |

(Continued)

*Primary Examiner* — Cheryl J Tyler
*Assistant Examiner* — Ana Vazquez

(57) ABSTRACT

A portable air conditioning system has a wheeled base and an insulated housing in a shape of a cube. A louver is located on a housing front panel. A louver and a pair of handles are located on a housing back panel. An insulated dividing panel divides an upper housing compartment and a lower housing compartment. A compressor coupled to a motor, a condenser, and a receiver are located in the lower housing compartment. An evaporator is located in the upper housing compartment. A suction line connects the accumulator to the compressor. An expansion tank is connected to the accumulator. A condensation pan is located above the dividing panel. An evaporator fan is located in the upper housing compartment and a condenser fan is located in the lower housing compartment. A thermostatic expansion valve is located on an inlet to the evaporator.

4 Claims, 6 Drawing Sheets

(56) References Cited

U.S. PATENT DOCUMENTS

| | | | | |
|---|---|---|---|---|
| 6,651,993 | B1 * | 11/2003 | Emerzian et al. | 280/47.34 |
| 6,698,235 | B2 | 3/2004 | Nobuta et al. | |
| 7,216,492 | B2 * | 5/2007 | Sellers | 62/77 |
| 7,231,777 | B1 | 6/2007 | Arnold et al. | |
| 7,281,389 | B1 * | 10/2007 | O'Brien et al. | 62/272 |
| 7,631,511 | B2 | 12/2009 | Al-Azmi et al. | |
| 2003/0051503 | A1 * | 3/2003 | Nobuta et al. | 62/509 |
| 2006/0107679 | A1 | 5/2006 | Pohr et al. | |
| 2006/0168976 | A1 | 8/2006 | Flynn et al. | |
| 2007/0000261 | A1 | 1/2007 | Flynn et al. | |
| 2008/0022712 | A1 | 1/2008 | Carr | |
| 2008/0034770 | A1 * | 2/2008 | Al-Azmi et al. | 62/199 |
| 2008/0104988 | A1 * | 5/2008 | Lee et al. | 62/285 |

* cited by examiner

PORTABLE AIR CONDITIONING SYSTEM

CROSS REFERENCE

This application claims priority to U.S. non-provisional application Ser. No. 12/541,031 filed Aug. 13, 2009 as a continuation-in-part, the specification of which is incorporated herein by reference in Its entirety.

BACKGROUND OF THE INVENTION

At present, air conditioners are typically standard features in newly constructed houses and buildings. Older buildings, however, may not be equipped with air conditioning systems. Portable air conditioning devices may be used, but they are typically cumbersome to transport and awkward in appearance. The present invention features a portable air conditioning system for easy introduction to and removal from a room. The present invention features pressure stabilization improvements and a design adapted for easy transport (including minimizing spillage of the condensation pan during transport) that easily integrates into a room.

SUMMARY

The present invention features a portable air conditioning system for easy introduction to and removal from a room. In some embodiments, the system comprises a generally planar base with a plurality of wheels located thereon.

In some embodiments, the system comprises a housing having a hollow cavity located therein. In some embodiments, the housing comprises a general shape of a cube. In some embodiments, a housing top, a housing bottom, a housing first side, and a housing second side are insulated.

In some embodiments, a housing front comprises a louver located on a front panel top half close to the housing top. In some embodiments, the housing front is insulated on a front panel bottom half close to the housing bottom. In some embodiments, a housing back is insulated on a back panel top half close to the housing top. In some embodiments, the housing back comprises a louver located on a back panel bottom half close to the housing bottom. In some embodiments, the housing is adapted to install on the base.

In some embodiments, the system comprises a first handle receiving tube located on the housing back. In some embodiments, the system comprises a first handle adapted to be inserted into the first handle receiving tube. In some embodiments, the system comprises a second handle receiving tube located on the housing back. In some embodiments, the system comprises a second handle adapted to be inserted into the second handle receiving tube.

In some embodiments, the system comprises an insulated dividing panel located in the housing. In some embodiments, the housing is divided into an upper housing compartment and a lower housing compartment via the insulated housing dividing panel.

In some embodiments, the system comprises a compressor coupled to a motor located on the base top surface in the lower housing compartment. In some embodiments, the system comprises a condenser fluidly connected to the compressor. In some embodiments, the system comprises a receiver fluidly connected to the condenser. In some embodiments, the condenser and the receiver are located in the lower housing compartment.

In some embodiments, the system comprises an evaporator fluidly connected to the condenser. In some embodiments, the evaporator is located in the upper housing compartment. In some embodiments, the system comprises an accumulator fluidly connected to the evaporator. In some embodiments, the system comprises a suction line fluidly connected to the accumulator. In some embodiments, the suction line is fluidly connected to the compressor. In some embodiments, the system comprises an expansion tank fluidly connected to the accumulator. In some embodiments, the system comprises a drain port located close to and fluidly connected to the evaporator or the accumulator.

In some embodiments, the system comprises a condensation pan slidably located on a top surface of the dividing panel. In some embodiments, the condensation pan comprises a splash guard located on the pan top. In some embodiments, the splash guard is adapted to prevent spillage when the system is tilted backward up to a specific angle. In some embodiments, the condensation pan is adapted to collect moisture and waste received from the drain port.

In some embodiments, the system comprises an evaporator fan located in the upper housing compartment. In some embodiments, the system comprises a condenser fan located in the lower housing compartment. In some embodiments, the system comprises a thermostatic expansion valve fluidly located on an inlet to the evaporator. In some embodiments, the system comprises a single compressor, a single condenser, a single evaporator, a single accumulator, and a single expansion tank fluidly connected in a circuit.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 6 further features the location of the compressor and the motor.

DESCRIPTION OF PREFERRED EMBODIMENTS

Figure 1:
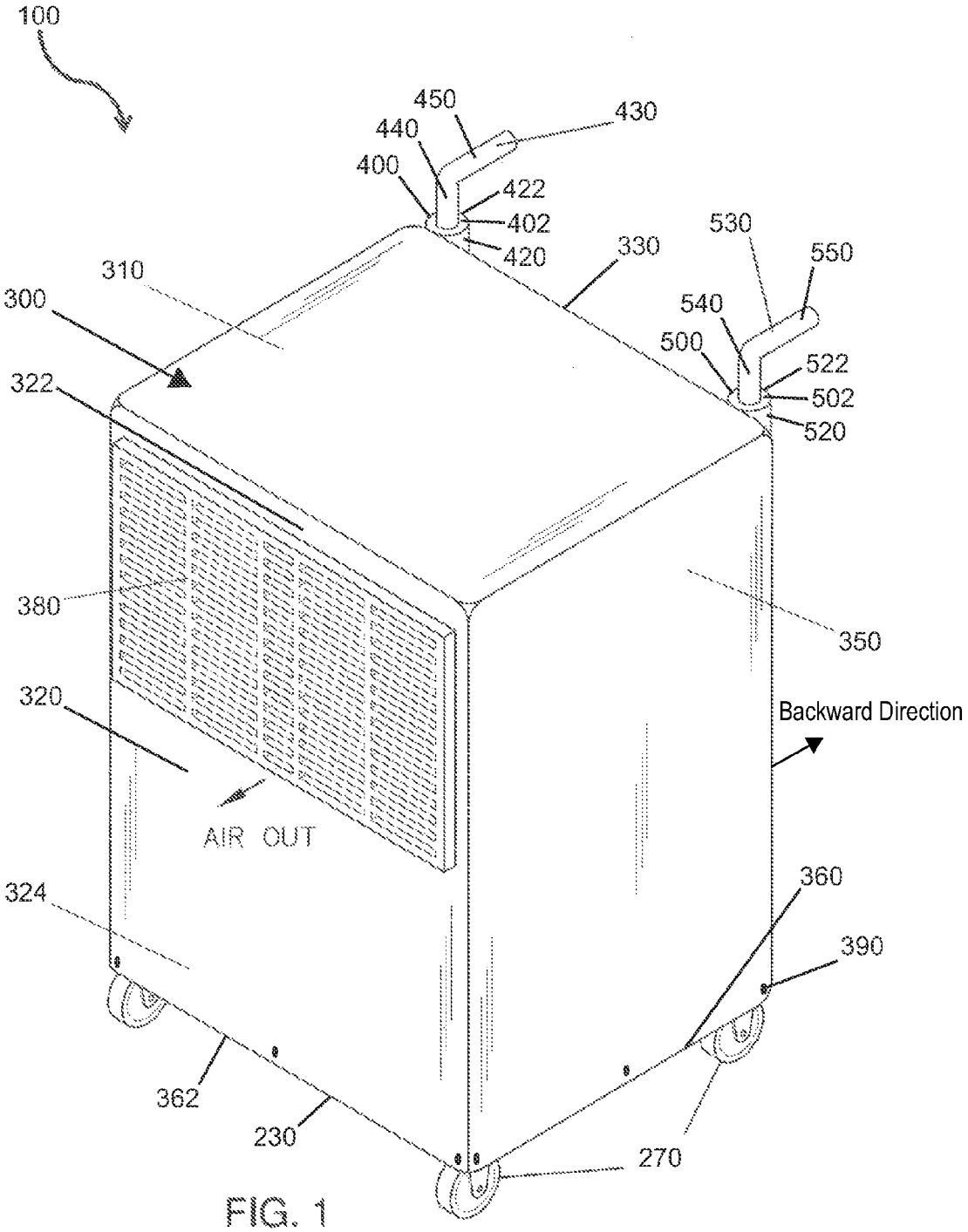
FIG. 1 is a frontal perspective view of the present invention.

Following is a list of elements corresponding to a particular element referred to herein:

100 Portable air conditioning system
200 Base
210 Base top surface
220 Base bottom surface
230 Base front edge
240 Base back edge
250 Base first edge
260 Base second edge
270 Wheel

Figure 2:
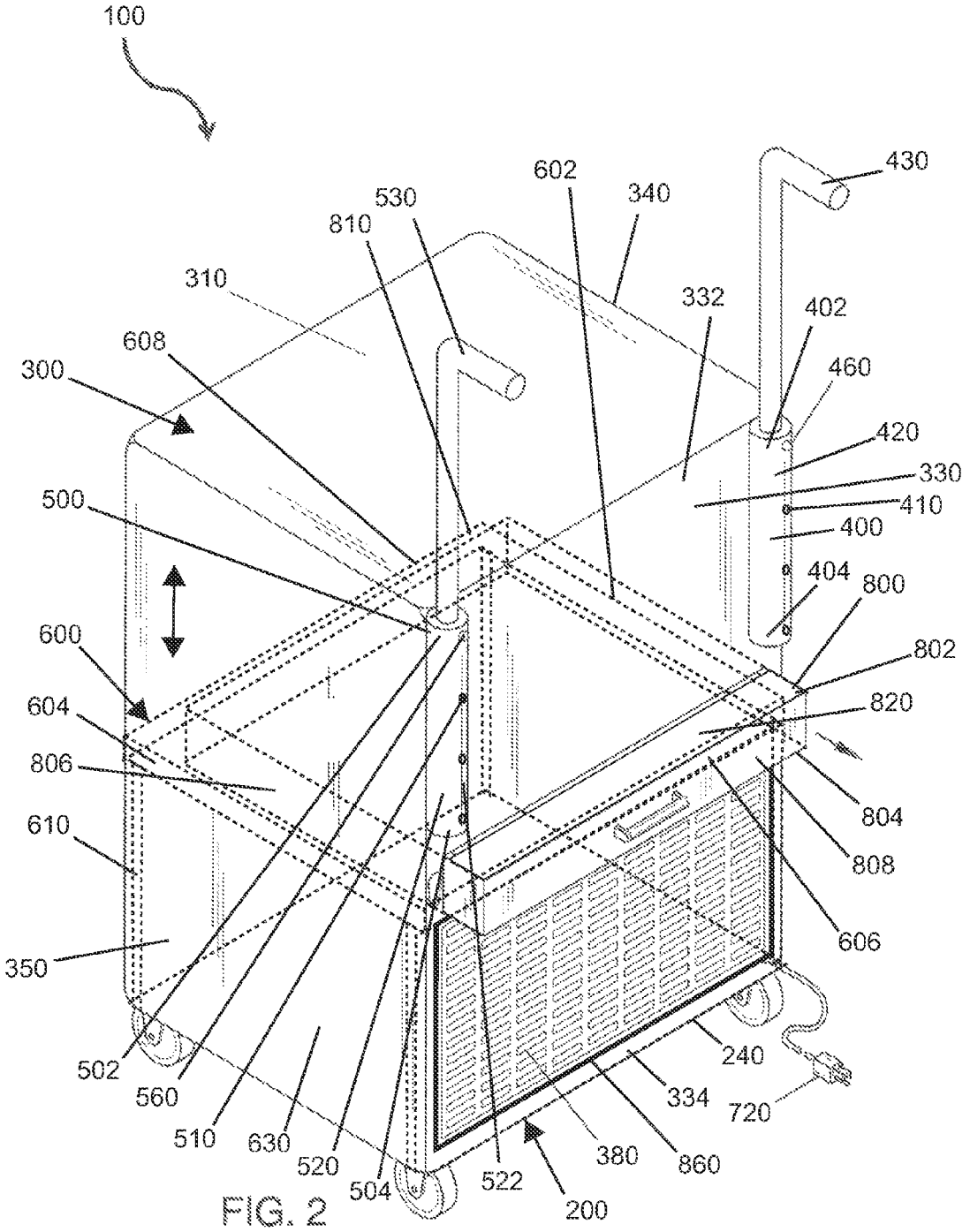
FIG. 2 is a rearward perspective view of the present invention featuring the dividing panel and the extension brackets.
Figure 3:
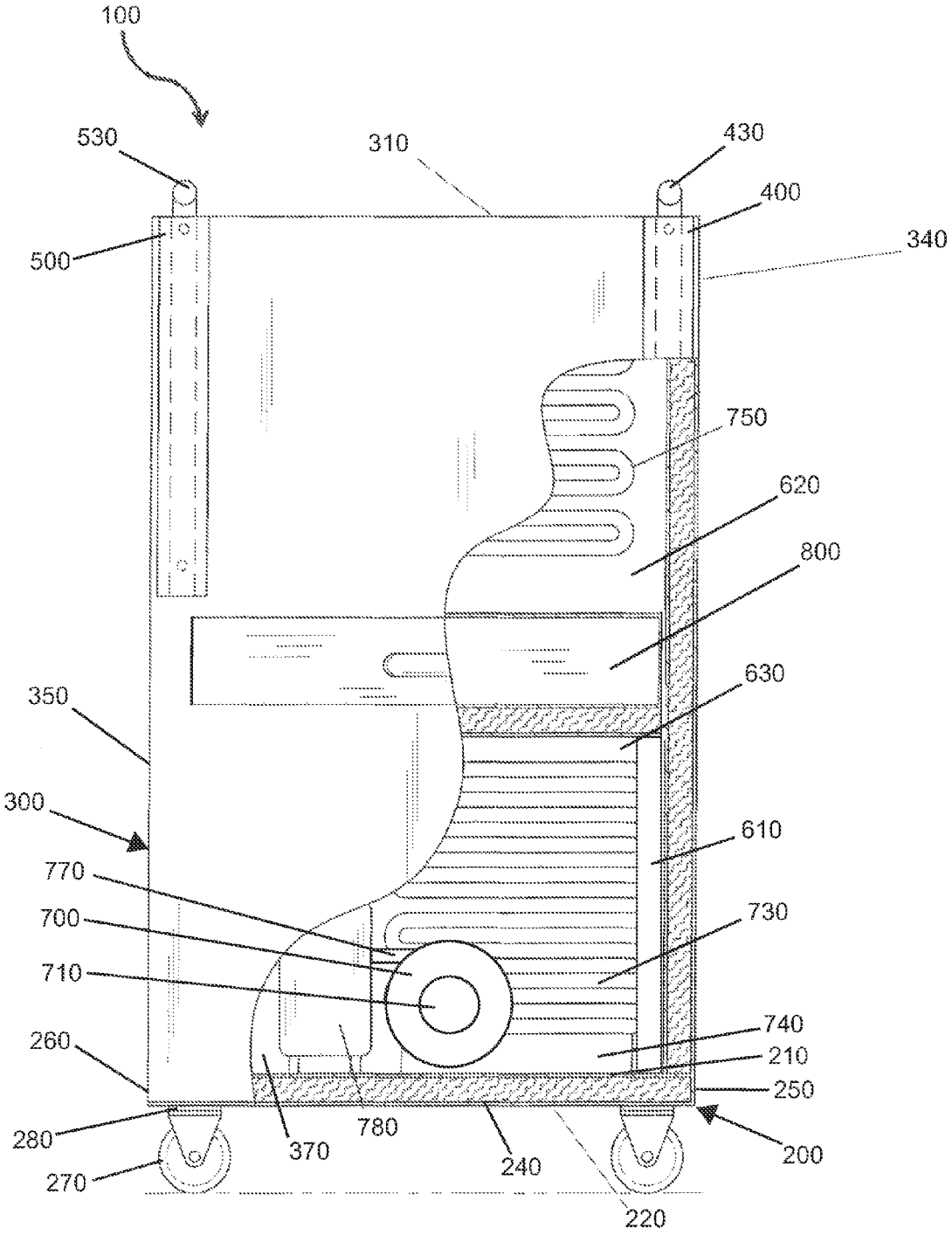
FIG. 3 is a rear view of the present invention featuring the positioning of the condenser, the evaporator, the compressor and the motor.
Figure 4:
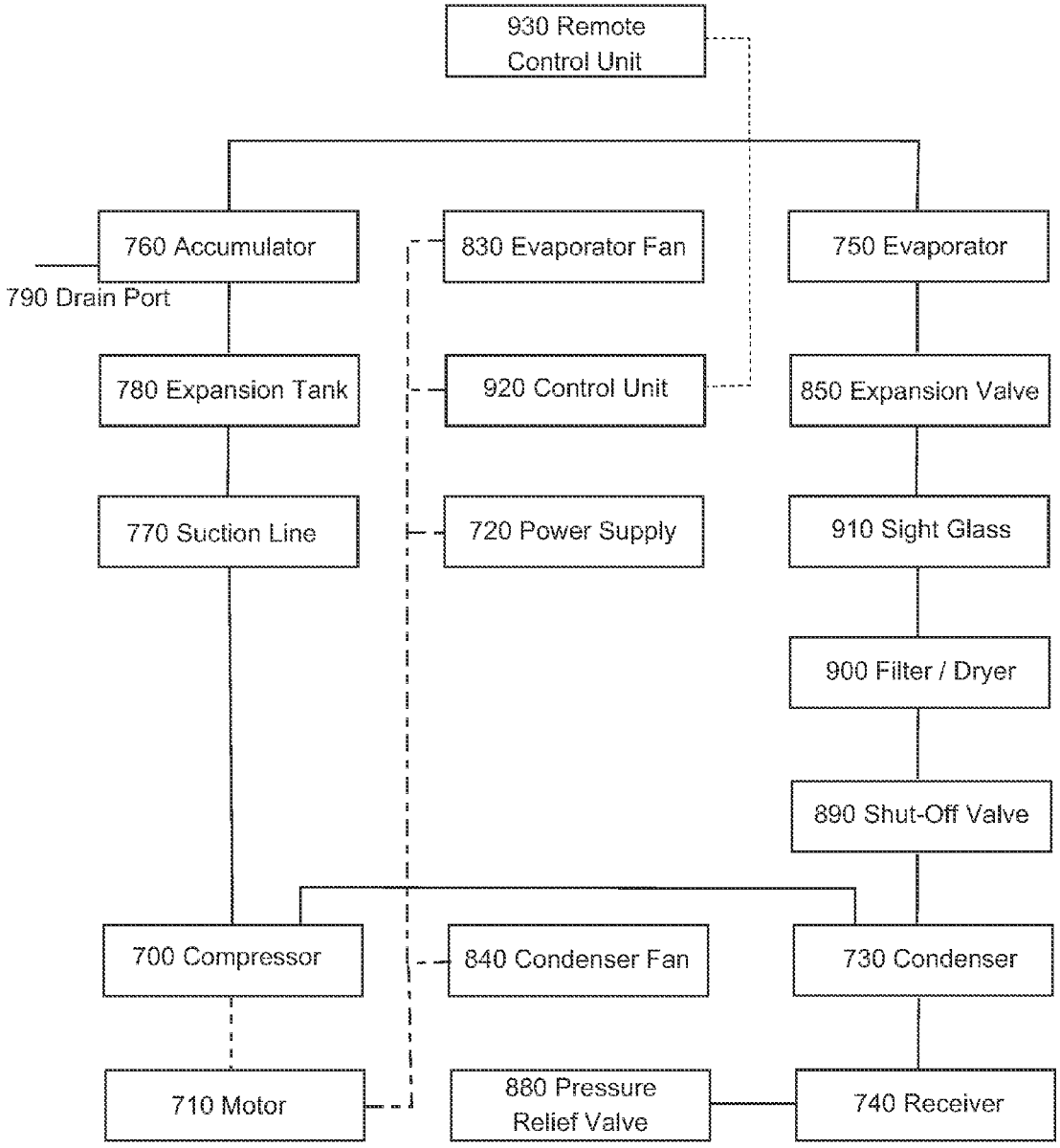
FIG. 4 is a schematic view of the present invention including components from alternate embodiment(s).
Figure 5:
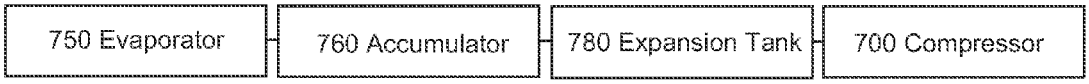
FIG. 5 is a schematic view of component orientation of the present invention.
Figure 6:
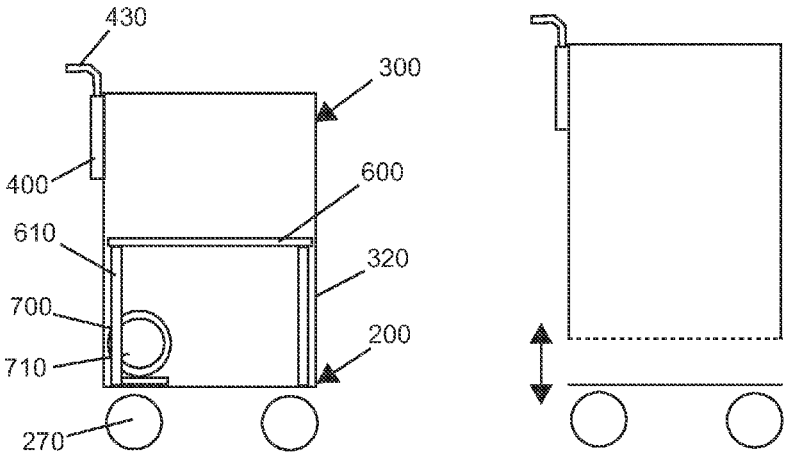
FIG. 6 is a side view of the base and housing of the present invention.
Figure 7:
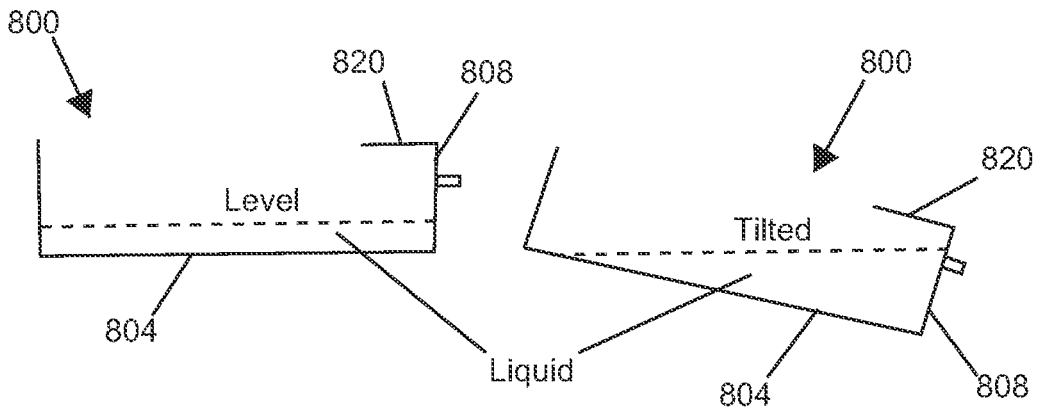
FIG. 7 is a side view of the condensation pan showing both level and inclined positions.

280 Swivel
300 Housing
310 Housing top
320 Housing front
322 Housing front top half
324 Housing front bottom half
330 Housing back
332 Housing back top half
334 Housing back bottom half
340 Housing first side
350 Housing second side
360 Housing bottom
362 Housing bottom aperture
370 Hollow cavity
380 Louver
390 Fastener
400 First handle receiving tube
402 First handle receiving tube top
404 First handle receiving tube bottom
410 First tube aperture
420 First handle receiving tube side wall
422 First handle receiving tube side wall most posterior point
430 First handle
440 First handle first leg
450 First handle second leg
460 First spring biased locking pin
500 Second handle receiving tube
502 Second handle receiving tube top
504 Second handle receiving tube bottom
510 Second tube aperture
520 Second handle receiving tube side wall
522 Second handle receiving tube side wall most posterior point
530 Second handle
540 Second handle first leg
550 Second handle second leg
560 Second spring biased locking pin
600 Dividing panel
602 Dividing panel first edge
604 Dividing panel second edge
606 Dividing panel front edge
608 Dividing panel back edge
610 Extension bracket
620 Upper housing compartment
630 Lower housing compartment
700 Compressor
710 Motor
720 Power supply
730 Condenser
740 Receiver
750 Evaporator
760 Accumulator
770 Suction line
780 Expansion tank
790 Drain port
800 Condensation pan
802 Pan top
804 Pan bottom
806 Pan side
808 Pan back
810 Dividing panel top surface
820 Splash guard
822 Splash guard terminating edge
830 Evaporator fan
840 Condenser fan
850 Expansion valve
860 Vent connection
870 Vent tube
880 Pressure relief valve
890 Shut-off valve
900 Filter/dryer
910 Sight glass
920 Control unit
930 Remote control unit
940 Table top
950 Chair seat Referring now to FIG. 1-7, the present invention features a portable air conditioning system (100) for easy introduction to and removal from a room. In some embodiments, the system (100) comprises a generally planar base (200) having a base top surface (210), a base bottom surface (220), a base front edge (230), a base back edge (240), a base first edge (250), and a base second edge (260). In some embodiments, the base bottom surface (220) comprises a plurality of wheels (270) located thereon. In some embodiments, the base bottom surface (220) comprises four wheels (270) located thereon. In some embodiments, at least one of the wheels (270) is located on a swivel (280). In some embodiments, two of the wheels (270) are each located on a swivel (280). In some embodiments, all the wheels (270) are each located on a swivel (280). In some embodiments, the plurality of wheels (270) is adapted to traverse a threshold of a standard interior doorway. In some embodiments, the wheels (270) are 1 Inch in diameter. In some embodiments, the wheels (270) are 2 inches in diameter. In some embodiments, the wheels (270) are 3 Inches in diameter. In some embodiments, the wheels (270) are 4 inches in diameter or greater.

In some embodiments, the system (100) comprises a unitary removable housing (300) having a generally planar housing top (310), a generally planar housing front (320), a generally planar housing back (330), a generally planar housing first side (340), a generally planar housing second side (350), a housing bottom (360) having a housing bottom aperture (362), and a hollow cavity (380) located therein fluidly connected to the housing bottom aperture (362). In some embodiments, the housing (300) comprises a general shape of a rectangular prism. In some embodiments, the housing (300) comprises a general shape of a cube. In some embodiments, the housing top (310) is insulated. In some embodiments, the housing first side (340) is insulated. In some embodiments, the housing second side (350) is insulated. In some embodiments, the insulation is fiberglass insulation. In some embodiments, the insulation is foam insulation. In some embodiments, the housing front (320) comprises a louver (380) located on a housing front top half (322) close to the housing top (310). In some embodiments, the housing front (320) comprises a plurality of louvers (380) located on a housing front top half (322) close to the housing top (310). In some embodiments, the housing front (320) is insulated on a housing front bottom half (324) close to the housing bottom (360). In some embodiments, the housing back (330) is insulated on a housing back top half (332) close to the housing top (310). In some embodiments, the housing back (330) comprises a louver (380) located on a housing back bottom half (334) close to the housing bottom (360). In some embodiments, the housing back (330) comprises a plurality of louvers (380) located on a housing back bottom half (334) close to the housing bottom (360). In some embodiments, the housing (300) is adapted to be slidably installed on the base (200). In some embodiments, the housing (300) is adapted to attachably connect to the base (200) close to the housing bottom (360) via a plurality of fasteners (390) located therein. In some embodiments, the housing (300) comprises apertures located on one or more sides close to the housing bottom (360) for receiving the fasteners (390).

In some embodiments, the system (100) comprises a first handle receiving tube (400) located on the housing back (330). In some embodiments, the first handle receiving tube (400) is located close to the housing top (310) and close to an Intersecting edge of the housing first side (340) and the housing back (330). In some embodiments, the first handle receiving tube (400) is longitudinally oriented parallel with respect to the intersecting edge of the housing first side (340) and the housing back (330). In some embodiments, the first handle receiving tube (400) comprises a plurality of first tube apertures (410) located on a first handle receiving tube side wall (420). In some embodiments, one first tube aperture (410) is located close to a first handle receiving tube top (402) on a first handle receiving tube side wall most posterior point (422). In some embodiments, one first tube aperture (410) is located close to a first handle receiving tube bottom (404) on the first handle receiving tube side wall most posterior point (422). In some embodiments, a plurality of first tube apertures (410) is incrementally vertically spaced on the first handle receiving tube side wall (420).

In some embodiments, the system (100) comprises a first handle (430) having a general shape of an "L". In some embodiments, a first handle first leg (440) is adapted to be slidably inserted into the first handle receiving tube (400). In some embodiments, the first handle first leg (440) comprises a first spring biased locking pin (460) located thereon. In some embodiments, the first spring biased locking pin (460) is adapted to securely engage the first tube aperture (410). In some embodiments, a first handle second leg (450) is perpendicularly located on the first handle first leg (440). In some embodiments, the first handle second leg (450) is adapted to project perpendicularly out and away from the housing back (330). In some embodiments, the first handle (430) is telescopically adjustable within the first handle receiving tube (400). In some embodiments, the first handle (430) expands and contracts perpendicularly out and away from the housing top (310). In some embodiments, the first handle (430) is removable from the first handle receiving tube (400).

In some embodiments, the system (100) comprises a second handle receiving tube (500) located on the housing back (330). In some embodiments, the second receiving tube is located close to the housing top (310) and close to an intersecting edge of the housing second side (350) and the housing back (330). In some embodiments, the second handle receiving tube (500) is longitudinally oriented parallel with respect to the intersecting edge of the housing second side (350) and the housing back (330). In some embodiments, the second handle receiving tube (500) comprises a plurality of second tube apertures (510) located on a second handle receiving tube side wall (520). In some embodiments, one second tube aperture (510) is located close to a second handle receiving tube top (502) on a second handle receiving tube side wall most posterior point (522). In some embodiments, one second tube aperture (510) is located close to a second handle receiving tube bottom (504) on the second handle receiving tube side wall most posterior point (522). In some embodiments, a plurality of second tube apertures (510) is incrementally vertically spaced on the first handle receiving tube side wall (520).

In some embodiments, the system (100) comprises a second handle (530) having a general shape of an "L". In some embodiments, a second handle first leg (540) is adapted to be slidably inserted into the second handle receiving tube (500). In some embodiments, the second handle first leg (540) comprises a second spring biased locking pin (560) located thereon. In some embodiments, the second spring biased locking pin (560) is adapted to securely engage the second tube aperture (510). In some embodiments, a second handle second leg (550) is perpendicularly located on the second handle first leg (540). In some embodiments, the second handle second leg (550) is adapted to project perpendicularly out and away from the housing back (330). In some embodiments, the second handle (530) is telescopically adjustable within the second handle receiving tube (500). In some embodiments, the second handle (530) expands and contracts perpendicularly out and away from the housing top (310). In some embodiments, the second handle (530) is removable from the second handle receiving tube (500).

In some embodiments, the system (100) comprises an insulated dividing panel (600) slidably located in the housing (300). In some embodiments, the dividing panel (600) is located on the base (200) via extension brackets (610). In some embodiments, the dividing panel (600) is located parallel to the base (200). In some embodiments, the housing (300) is divided into an upper housing compartment (620) and a lower housing compartment (630) via the insulated housing dividing panel (600). In some embodiments, a housing dividing panel first edge (602) slidably interfaces with a housing first side (340) interior surface. In some embodiments, a housing dividing panel second edge (604) slidably interfaces with a housing second side (350) interior surface. In some embodiments, the housing dividing panel front edge (606) slidably interfaces with a housing front (320) interior surface. In some embodiments, the housing dividing panel back edge (608) slidably interfaces with a housing back (330) interior surface.

In some embodiments, the system (100) comprises a compressor (700) coupled to a motor (710). In some embodiments, the motor (710) is operatively connected to a power supply (720). In some embodiments, the power supply (720) is alternating current electricity. In some embodiments, the power supply (720) is direct current electricity from a battery. In some embodiments, the compressor (700) and the motor (710) are located on the base top surface (210). In some embodiments, the compressor (700) and the motor (710) are located midway between the base first edge (250) and the base second edge (260). In some embodiments, the compressor (700) and the motor (710) are located close to the base back edge (240). In some embodiments, the compressor (700) and the motor (710) are located in the lower housing compartment (630). In some embodiments the location of the compressor (700) and motor (710) are critical for stable weight distribution when pivoting the system (100) for transport.

In some embodiments, the system (100) comprises a condenser (730) fluidly connected to the compressor (700). In some embodiments, the condenser (730) is located in the lower housing compartment (630).

In some embodiments, the system (100) comprises a receiver (740) fluidly connected to the condenser (730). In some embodiments, the receiver (740) is located in the lower housing compartment (630). In some embodiments, the receiver (740) is adapted to store a volume of refrigerant. In some embodiments, the receiver (740) assists in pressure stabilization.

In some embodiments, the system (100) comprises an evaporator (750) fluidly connected to the condenser (730). In some embodiments, the evaporator (750) is located in the upper housing compartment (620).

In some embodiments, the system (100) comprises an accumulator (760) fluidly connected to the evaporator (750). In some embodiments, the accumulator (760) is located close to the evaporator (750). In some embodiments, the accumulator (760) is adapted to de-entrain liquid refrigerant from the gas refrigerant. In some embodiments, the accumulator (760) is adapted to store a volume of refrigerant. In some embodiments, the accumulator (760) assists in pressure stabilization.

In some embodiments, the system (100) comprises a suction line (770) fluidly connected to the accumulator (760). In some embodiments, the suction line (770) is fluidly connected to the compressor (700). In some embodiments, tubing is used to fluidly connect components. In some embodiments, the suction line (770) is comprised of tubing or piping.

In some embodiments, the system (100) comprises an expansion tank (780) fluidly connected to the accumulator (760). In some embodiments, the expansion tank (780) is adapted to store a volume of refrigerant. In some embodiments, the expansion tank (780) assists in pressure stabilization.

In some embodiments, the accumulator (760) and the expansion tank (780) are adapted to provide additional volume to the refrigerant circuit. In some embodiments, the additional volume added to the refrigerant circuit from the accumulator (760) and the expansion tank (780) aids in pressure stabilization. In some embodiments, the additional volume added to the refrigerant circuit from the accumulator (760) and the expansion tank (780) is believed to contribute to smoother operation of the system (100).

In some embodiments, the system (100) comprises a drain port (790) located close to and fluidly connected to the evaporator (750) or the accumulator (760). In some embodiments, the drain port (790) is adapted to drain moisture and waste (or foreign matter). In some embodiments, the drain port (790) is adapted to transfer pressurized refrigerant. In some embodiments, the drain port (790) comprises a pressure fitting located on the end.

In some embodiments, the system (100) comprises a condensation pan (800) slidably located on a dividing panel top surface (810). In some embodiments, the condensation pan (800) comprises a generally open pan top (802), a pan bottom (804), and a plurality of pan sides (806) sealably located on the pan bottom (804). In some embodiments, the condensation pan (800) is adapted to collect condensation falling from the evaporator (750). In some embodiments, the condensation pan (800) comprises a splash guard (820) sealably located on the pan top (802). In some embodiments, the splash guard (820) is adapted to prevent spillage when the system (100) is tilted backward during transport up to a specific angle. In some embodiments, the condensation pan (800) is adapted to collect moisture and waste received from the drain port (790). In some embodiments, an aperture is located in the housing back (330) for insertion and removal of the condensation pan (800).

In some embodiments, the splash guard (820) is planar and parallel with respect to the pan bottom (804). In some embodiments, the splash guard (820) extends from a top rim of the pan back (808) away from the pan back (808) for a distance. In some embodiments, the distance is one inch. In some embodiments, the distance is two inches. In some embodiments, the distance is three inches or more. In some embodiments, the splash guard (820) traverses an entire width of the pan back (808) and sealably contacts a top rim of each pan side (806) located on the adjoining side edge of the pan back (808). In some embodiments, the splash guard comprises a splash guard terminating edge (822) that faces and extends toward a top rim of the pan side (806) located opposed to the pan back (808). In some embodiments, the splash guard terminating edge (822) is linear. In some embodiments, the splash guard terminating edge (822) is curved. In some embodiments, the surface area of the splash guard (820) is less than one half of the surface area of the pan bottom (804). In some embodiments, the splash guard (820) hovers over the pan top (802). In some embodiments, the splash guard (820) is rectangular.

In some embodiments, the system (100) comprises an evaporator fan (830) located in the upper housing compartment (620). In some embodiments, the evaporator fan (830) is operatively connected to the power supply (720). In some embodiments, the evaporator fan (830) is for circulating air across the evaporator (750) for cooling. In some embodiments, the cooled air is expelled through the louver (380) located on the housing front top half (322) into a room.

In some embodiments, the system (100) comprises a condenser fan (840) located in the lower housing compartment (630). In some embodiments, the condenser fan (840) is operatively connected to the power supply (720). In some embodiments, the condenser fan (840) is for circulating air across the condenser (730) for removing heat from the system (100). In some embodiments, the heated air is expelled through the louver (380) located on the housing back bottom half (334).

In some embodiments, the system (100) comprises a thermostatic expansion valve (850) fluidly located on an inlet to the evaporator (750). In some embodiments, the thermostatic expansion valve (850) controls the flow of refrigerant. Thermostatic expansion valves (850) are well known to one of ordinary skill in the art.

In some embodiments, the system (100) is adapted to be pushed on the wheels (270) for transport via the first handle (430) and the second handle (530). In some embodiments, the system (100) is adapted to be tilted backward and pushed on the wheels (270) for transport via the first handle (430) and the second handle (530). In some embodiments, the system (100) is adapted to be tilted backward and pushed on the wheels (270) for transport via the rearward location of the compressor (700) and the motor (710). In some embodiments, the system (100) is adapted to be tilted backward and pushed on the wheels (270) for transport via the splash guard (820) located on the condensation pen (800) preventing spillage. In some embodiments, the system (100) comprises only a single compressor (700), only a single condenser (730), only a single evaporator (750), only a single accumulator (760), and only a single expansion tank (780) fluidly connected in a circuit. In some embodiments, the system (100) is adapted to fit through the standard interior doorway.

In some embodiments, a vent connection (860) is located on the housing back (330) for attaching a vent tube over the louver (380). In some embodiments, the vent tube can be directed away from the system (100). In some embodiments the vent tube can be directed out a doorway or window.

In some embodiments, a pressure relief valve (880) is located on and fluidly connected to the receiver (740). Pressure relief valves (880) are well known to those of ordinary skill in the art.

In some embodiments, a shut-off valve (890) is located between and fluidly connected to the condenser (730) and the evaporator (750). Shut-off valves (890) are well known to those of ordinary skill in the art.

In some embodiments, a filter/dryer (900) is located between and fluidly connected to the condenser (730) and the evaporator (750). Filter/dryers (900) are well known to those of ordinary skill in the art.

In some embodiments, a sight glass (910) is located between and fluidly connected to the condenser (730) and the evaporator (750). Sight glasses (910) are well known to those of ordinary skill in the art.

In some embodiments, the system (100) comprises a control unit (920) operatively connected to the power supply (720). Control units (920) are well known to those of ordinary skill in the art.

In some embodiments, the system (100) comprises a remote control unit (930) operatively connected to the control unit (920). Remote control units (930) are well known to those of ordinary skill in the art.

In some embodiments, the housing top (310) comprises a table top (940) located thereon. In some embodiments, the table top (940) is removable and replaceable. In some embodiments, the table top (940) attached to the system (100) allows the system (100) to effectively integrate into a room.

In some embodiments, the housing top (310) comprises a chair seat (950) located thereon. In some embodiments, the chair seat (950) is removable and replaceable. In some embodiments, the chair seat (950) attached to the system (100) allows the system (100) to effectively integrate into a room.

As used herein, the term "about" refers to plus or minus 10% of the referenced number. For example, an embodiment wherein the first handle is about 10 inches in length includes a first handle that is between 9 and 11 inches in length.

The disclosures of the following U.S. Patents are incorporated in their entirety by reference herein: U.S. Patent Publication No. 2008/0104988; U.S. Pat. No. 2,661,606; U.S. Pat. No. 2,797,851; U.S. Pat. No. 3,524,328; U.S. Pat. No. 5,737,938; U.S. Pat. No. 6,539,735; U.S. Pat. No. 7,137,764; and U.S. Pat. No. 7,603,875.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the Invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A portable air conditioning system (100) for easy introduction to and removal from a room, wherein said system (100) comprises:

(a) a planar base (200) having a base top surface (210), a base bottom surface (220), a base front edge (230), a base back edge (240), a base first edge (250), and a base second edge (260), wherein the base bottom surface (220) comprises a plurality of wheels (270) disposed thereon, wherein at least one of the wheels (270) is disposed on a swivel (280), wherein the plurality of wheels (270) is adapted to traverse a threshold of a doorway;

(b) a unitary removable housing (300) having a planar housing top (310), a planar housing front (320), a planar housing back (330), a planar housing first side (340), a planar housing second side (350), a housing bottom (360) having a housing bottom aperture (362), and a hollow cavity (380) disposed therein fluidly connected to the housing bottom aperture (362), wherein the housing (300) comprises a rectangle, wherein the housing top (310) is insulated, wherein the housing first side (340) is insulated, wherein the housing second side (350) is insulated, wherein the housing front (320) comprises a louver (380) disposed on a housing front top half (322) proximal to the housing top (310), wherein the housing front (320) is insulated on a housing front bottom half (324) proximal to the housing bottom (360), wherein the housing back (330) is insulated on a housing back top half (332) proximal to the housing top (310), wherein the housing back (330) comprises a louver (380) disposed on a housing back bottom half (334) proximal to the housing bottom (360), wherein the housing (300) is installed on the base (200), wherein the housing (300) is connected to the base (200) proximal to the housing bottom (360) via a plurality of fasteners (390) disposed thereon;

(c) a first handle receiving tube (400) disposed on the housing back (330), wherein the first handle receiving tube (400) is disposed proximal to the housing top (310) and proximal to an intersecting edge of the housing first side (340) and the housing back (330), wherein the first handle receiving tube (400) is longitudinally oriented parallel with respect to the intersecting edge of the housing first side (340) and the housing back (330), wherein the first handle receiving tube (400) comprises a plurality of first tube apertures (410) disposed on a first handle receiving tube side wall (420), wherein one first tube aperture (410) is disposed proximal to a first handle receiving tube top (402) on a first handle receiving tube side wall most posterior point (422), wherein one first tube aperture (410) is disposed proximal to a first handle receiving tube bottom (404) on the first handle receiving tube side wall most posterior point (422);

(d) a first handle (430) having a shape of an "L", wherein a first handle first leg (440) is inserted into the first handle receiving tube (400), wherein the first handle first leg (440) comprises a first spring biased locking pin (460) disposed thereon, wherein the first spring biased locking pin (460) is adapted to securely engage the first tube aperture (410), wherein a first handle second leg (450) is perpendicularly disposed on the first handle first leg (440), wherein the first handle second leg (450) is adapted to project perpendicularly out and away from the housing back (330), wherein the first handle (430) is telescopically adjustable within the first handle receiving tube (400), wherein the first handle (430) is removable from the first handle receiving tube (400);

(e) a second handle receiving tube (500) disposed on the housing back (330), wherein the second receiving tube is disposed proximal to the housing top (310) and proximal to an intersecting edge of the housing second side (350) and the housing back (330), wherein the second handle receiving tube (500) is longitudinally oriented parallel with respect to the intersecting edge of the housing second side (350) and the housing back (330), wherein the second handle receiving tube (500) comprises a plurality of second tube apertures (510) disposed on a second handle receiving tube side wall (520), wherein one second tube aperture (510) is disposed proximal to a second handle receiving tube top (502) on a second handle receiving tube side wall most posterior point (522), wherein one second tube aperture (510) is disposed proximal to a second handle receiving tube bottom (504) on the second handle receiving tube side wall most posterior point (522);

(f) a second handle (530) having a shape of an "L", wherein a second handle first leg (540) is inserted into the second handle receiving tube (500), wherein the second handle first leg (540) comprises a second spring biased locking pin (560) disposed thereon, wherein the second spring biased locking pin (560) is adapted to securely engage the second tube aperture (510), wherein a second handle second leg (550) is perpendicularly disposed on the second handle first leg (540), wherein the second handle second leg (550) is adapted to project perpendicularly out and away from the housing back (330), wherein the second handle (530) is telescopically adjustable within the second handle receiving tube (500), wherein the second handle (530) is removable from the second handle receiving tube (500);

(g) an insulated dividing panel (600) slidably disposed in the housing (300), wherein the insulated dividing panel (600) is disposed on the base (200) via extension brackets (610), wherein the insulated dividing panel (600) is disposed parallel to the base (200), wherein the housing (300) is divided into an upper housing compartment (620) and a lower housing compartment (630) via the insulated dividing panel (600), wherein an insulated dividing panel first edge (602) engages with a housing first side (340) interior surface, wherein an insulated dividing panel second edge (604) engages with a housing second side (350) interior surface, wherein an insulated dividing panel front edge (606) engages with a housing front (320) interior surface, wherein an insulated dividing panel back edge (608) engages with a housing back (330) interior surface;

(h) a compressor (700) coupled to a motor (710), wherein the motor (710) is operatively connected to a power supply (720), wherein the compressor (700) and the motor (710) are disposed on the base top surface (210), wherein the compressor (700) and the motor (710) are disposed midway between the base first edge (250) and the base second edge (260), wherein the compressor (700) and the motor (710) are disposed proximal to the base back edge (240), wherein the compressor (700) and the motor (710) are disposed in the lower housing compartment (630);

(i) a condenser (730) fluidly connected to the compressor (700), wherein the condenser (730) is disposed in the lower housing compartment (630);

(j) a receiver (740) fluidly connected to the condenser (730); wherein the receiver (740) is disposed in the lower housing compartment (630);

(k) an evaporator (750) fluidly connected to the condenser (730), wherein the evaporator (750) is disposed in the upper housing compartment (620);

(l) an accumulator (760) fluidly connected to the evaporator (750), wherein the accumulator (760) is disposed proximal to the evaporator (750);

(m) a suction line (770) fluidly connected to the accumulator (760), wherein the suction line (770) is fluidly connected to the compressor (700);

(n) an expansion tank (780) fluidly connected to the accumulator (760);

(o) a drain port (790) disposed proximal to and fluidly connected to the evaporator (750) or the accumulator (760), wherein the drain port (790) is adapted to drain moisture and waste, wherein the drain port (790) is adapted to transfer pressurized refrigerant;

(p) a condensation pan (800) slidably disposed on an insulated dividing panel top surface (810), wherein the condensation pan (800) comprises a open pan top (802), a pan bottom (804), and a plurality of pan sides (806) with a pan back (808) disposed on the pan bottom (804), wherein the condensation pan (800) is adapted to collect condensation falling from the evaporator (750), wherein the condensation pan (800) comprises a splash guard (820) disposed on the pan top (802), wherein the splash guard (820) is planar and parallel with respect to the pan bottom (804), wherein the splash guard (820) extends from a top rim of the pan back (808) away from the pan back (808), wherein the splash guard (820) traverses an entire width of the pan back (808) and contacts a top rim of each pan side (806) such that the splash guard is connected to the top rim of each pan side (806) and the top rim of the pan back (808), wherein the splash guard comprises a splash guard terminating edge (822) that extends toward the top rim of each pan side (806), wherein the surface area of the splash guard (820) is less than one half of the surface area of the pan bottom (804), wherein the splash guard (820) extends over the pan top (802), wherein the splash guard (820) is adapted to prevent spillage when the system (100) is tilted in a backward direction during transport up to a specific angle, wherein the backward direction is from the planar housing front (320) to the planar housing back (330), wherein the condensation pan (800) is adapted to collect moisture and waste received from the drain port (790);

(q) an evaporator fan (830) disposed in the upper housing compartment (620), wherein the evaporator fan (830) is operatively connected to the power supply (720), wherein the evaporator fan (830) is for circulating air across the evaporator (750) for cooling, wherein the cooled air is expelled through the louver (380) disposed on the housing front top half (322) into the room;

(r) a condenser fan (840) disposed in the lower housing compartment (630), wherein the condenser fan (840) is operatively connected to the power supply (720), wherein the condenser fan (840) is for circulating air across the condenser (730) for heat removal from the system (100), wherein the heated air is expelled through the louver (380) disposed on the housing back bottom half (334); and (s) a thermostatic expansion valve (850) fluidly disposed on an inlet to the evaporator (750);

wherein the system (100) is pushed on the wheels (270) for transport via the first handle (430) and the second handle (530), wherein the system (100) is adapted to be tilted backward and pushed on the wheels (270) for transport via the first handle (430) and the second handle (530), wherein the system (100) is adapted to be tilted backward and pushed on the wheels (270) for transport whereby the splash guard (820) disposed on the condensation pan (800) prevents spillage.

2. The system (100) of claim 1, wherein a vent connection (860) is disposed on the housing back (330) for attaching a vent tube over the louver (380).

3. The system (100) of claim 1, wherein a pressure relief valve (880) is disposed on and fluidly connected to the receiver (740).

4. The system (100) of claim 1, wherein a shut-off valve (890) is disposed between and fluidly connected to the condenser (730) and the evaporator (750).

* * * * *